US006520830B1

(12) United States Patent
Vollmar et al.

(10) Patent No.: US 6,520,830 B1
(45) Date of Patent: Feb. 18, 2003

(54) CEILING MOUNTED MODEL TOY RAILING SYSTEM AND METHOD THEREFOR

(76) Inventors: Mark E. Vollmar, 20053 N. 98th La., Peoria, AZ (US) 85382; Eric Vollmar, 5752 W. Campo Bello, Glendale, AZ (US) 85308

( * ) Notice: Subject to any disclaimer, the term of this patent is extended or adjusted under 35 U.S.C. 154(b) by 0 days.

(21) Appl. No.: 09/970,136

(22) Filed: Oct. 3, 2001

(51) Int. Cl.[7] ..... A63H 30/02
(52) U.S. Cl. ..... 446/444; 446/484; 104/93
(58) Field of Search ..... 446/433, 444, 446/445, 467, 484; 104/89, 93, 118

(56) References Cited

U.S. PATENT DOCUMENTS

| | | | | |
|---|---|---|---|---|
| 2,492,319 A | | 12/1949 | Rendine | |
| 2,628,691 A | | 2/1953 | Barrett | |
| 2,680,619 A | | 6/1954 | Reiter | |
| 2,793,860 A | | 5/1957 | Crescenzo | |
| 2,962,563 A | | 11/1960 | Davis | |
| 3,041,983 A | | 7/1962 | Liversidge | |
| 4,037,358 A | | 7/1977 | Rosenbaum | |
| 4,106,695 A | | 8/1978 | Carella et al. | |
| 4,388,036 A | * | 6/1983 | Okamoto | 104/302 |
| 4,719,725 A | | 1/1988 | Weiner | |
| 5,231,932 A | | 8/1993 | Enderlein et al. | |
| 5,626,504 A | * | 5/1997 | Liu | 104/118 |
| 6,058,849 A | * | 5/2000 | Ostholt et al. | 104/139 |

* cited by examiner

*Primary Examiner*—Jacob K. Ackun
(74) *Attorney, Agent, or Firm*—Jeffrey D. Moy; Harry M. Weiss; Weiss, Moy, & Harris, P.C.

(57) ABSTRACT

A toy model transportation system has a track. mounted on a ceiling of a room where the system is to be installed. The track is comprised of a tubular member which has a channel which runs along a length of the track. A pair of contact strips are coupled within the tubular member. A power supply is coupled to the pair of contact strips. A caddy is positioned within the tubular member and is coupled to the contact strips and is powered by the power supply through the contact strips.

17 Claims, 3 Drawing Sheets

CEILING MOUNTED MODEL TOY RAILING SYSTEM AND METHOD THEREFOR

BACKGROUND OF THE INVENTION

1. Field of the Invention

This invention relates to model toys such as automobiles, planes, rockets, ships, trains and the like and, more specifically, to a ceiling mounted railing system which will allow model toys to look as if they are flying in the air.

2. Description of the Prior Art

Present model train systems have a set of tracks which are generally placed on the floor or a table where the system will be constructed. The tracks serves two different purposes. The first is to serve as a roadway or path over which the model train will travel. The second purpose of the track is to serve as a power distribution means. The metal track is used to send an electrical current to one or more of the cars equipped with a motor. The electric current will power the motor so that the energized car may pull the model train around the track.

The above type of train systems have several problems. First, the tracks consume a large amount of floor space. If a train system is set up in a child's room, the child will have a very limited amount of space in which to walk. This could be potentially dangerous, as the child or an adult may trip and fall over the tracks. Second, in operation, the tracks are electrified. Thus, a child may get hurt by touching the tracks. Third, the track system only allows train cars to run on the track. Other types of models like cars and airplanes can not run on the track. Plus, only certain types of train cars may be used. The train cars must be specially designed to run on a particular track.

Therefore, a need existed to provide an improved track system for model toys. The improved track system must not take up a lot of floor space. The improved track system must further protect young children from touching the track and getting an electric shock. The improved track system must further allow different types of toy models to run on the track system.

SUMMARY OF THE INVENTION

In accordance with one embodiment of the present invention, it is an object of the present invention to provide an improved track system for model toys.

It is another object of the present invention to provide an improved track system for model toys that protect young children from touching the track and getting an electric shock.

It is still another object of the present invention to provide an improved track system for model toys that allow different types of toy models to run on the track system.

BRIEF DESCRIPTION OF THE PREFERRED EMBODIMENTS

In accordance with one embodiment of the present invention a toy model transportation system is disclosed. The toy model transportation system has a track mounted on a ceiling of a room where the system is to be installed. The track is comprised of a tubular member which has a channel which runs along a length of the track. A pair of contact strips are coupled within the tubular member. A power supply is coupled to the pair of contact strips. A caddy is positioned within the tubular member and is coupled to the contact strips and is powered by the power supply through the contact strips.

In accordance with another embodiment of the present invention, a method of providing a toy model transportation system is disclosed. The method comprises the steps of: mounting a track on a ceiling of a room wherein the track is comprised of a tubular member having a channel which runs along a length of the track; attaching a pair of contact strips within the tubular member; coupling a power supply to the pair of contact strips; and positioning a caddy within the tubular member and coupled to the contact strips.

The foregoing and other objects, features, and advantages of the invention will be apparent from the following, more particular, description of the preferred embodiments of the invention, as illustrated in the accompanying drawing.

BRIEF DESCRIPTION OF THE DRAWINGS

The novel features believed characteristic of the invention are set forth in the appended claims. The invention itself, as well as a preferred mode of use, and advantages thereof, will best be understood by reference to the following detailed description of illustrated embodiments when read in conjunction with the accompanying drawings, wherein like reference numerals and symbols represent like elements.

DETAILED DESCRIPTION OF THE PREFERRED EMBODIMENT

Figure 1:
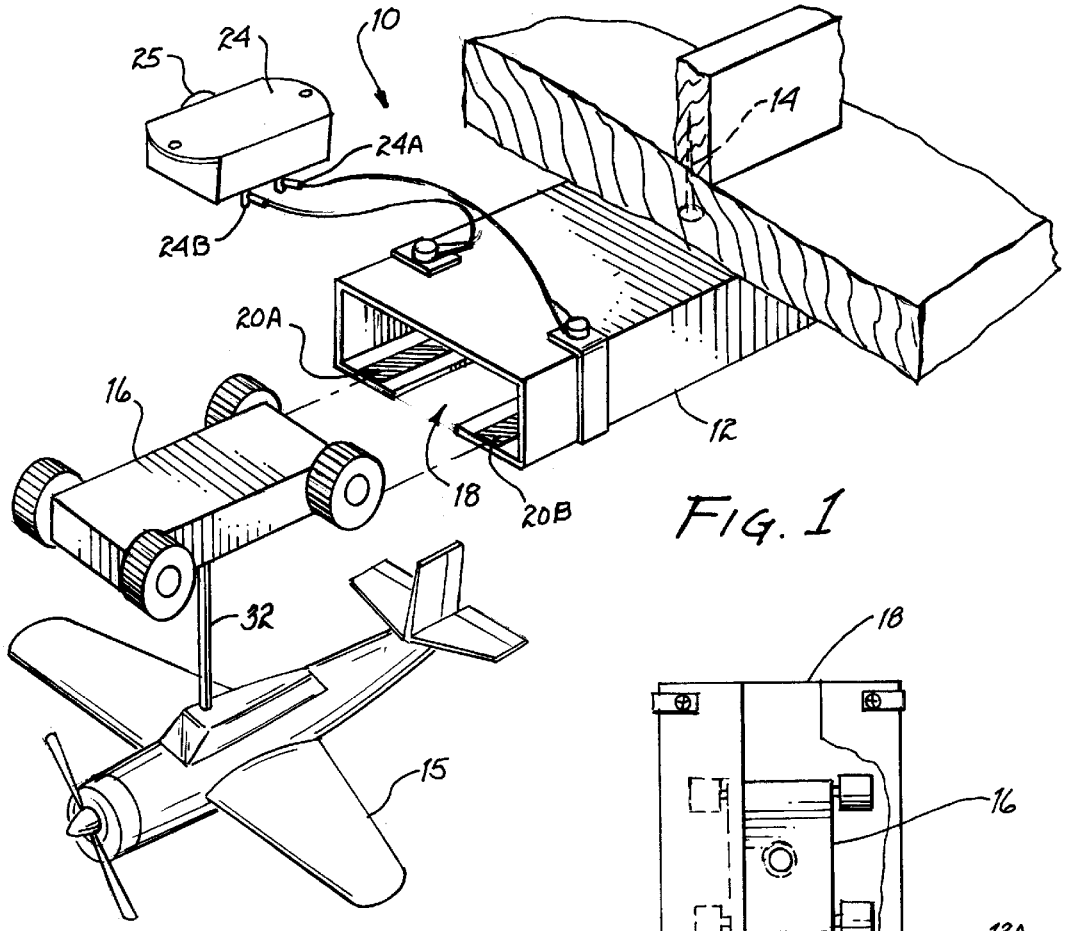
FIG. 1 is an elevated perspective view of one section of the ceiling mounted railing system for model toys of the present invention.

Referring to the Figures wherein like numerals and symbols represent like elements, a ceiling mounted railing system for model toys 10 (hereinafter system 10) is shown. The system 10 will have a track 12. The track 12 is mounted on the ceiling of a room where the system 10 is to be installed. The track 12 may be permanently or removably coupled to the ceiling. A plurality of connectors 14 are used to couple the track 12 to the ceiling. The connectors 14 are spaced apart at a distance to securely mount the track 12 to the ceiling. If the connectors 14 are spaced too far apart, the track 12 may have a tendency to fall away from the ceiling. Any type of connector 14 may be used to coupled the track 12 to the ceiling. The connectors 14 may be screws, rivets or the like. The connectors 14 may further be brackets, "U" joints, or items of a similar nature. It should be stated that the above mentioned connectors 14 are used as an example and should not be seen as to limit the scope of the present invention.

Figure 6:
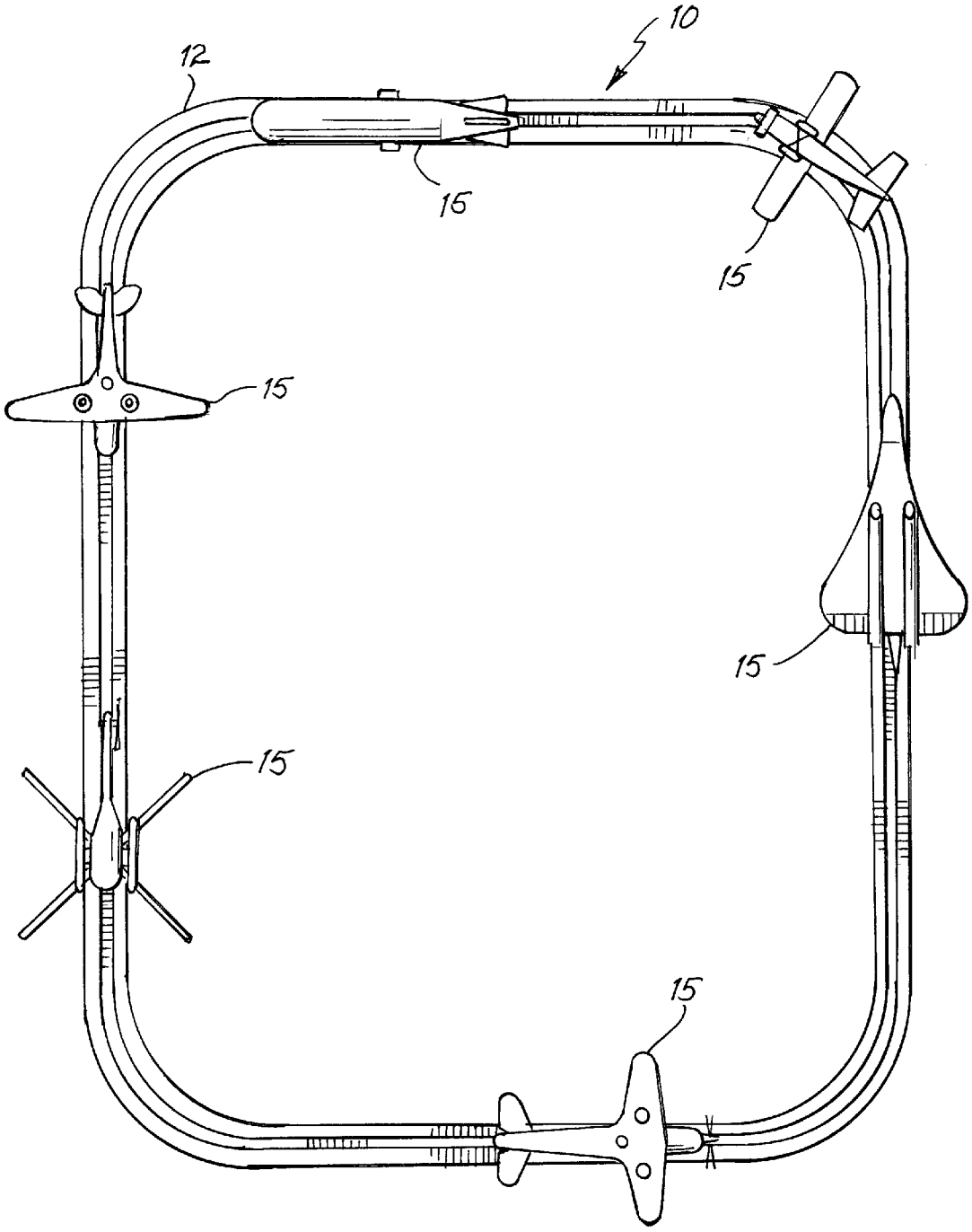
FIG. 6 is a bottom view of the ceiling mounted railing system for model toys of the present invention.

The track 12 may be laid on the ceiling in any type of configuration as long as there is no crossing of the track 12 so that the toy models 15 will not interfere with one another. Further, the track 12 must form a complete loop so as to form a complete electrical circuit. In accordance with one embodiment of the present invention, the track 12 is laid in a rectangular configuration around the outer perimeter of the ceiling as shown in FIG. 6. However, this is shown only as an example and should not be seen as to limit the scope of the present invention.

The track 12 is constructed out of a light weight but sturdy material. In general, the material that the track 12 is made out of is non-conductive. This will prevent individuals from being shocked if they inadvertently touch the track 12 when the track 12 is energized. Some examples of the material that the track 12 may be made out of include, but is not limited to, plastic, wood, and the like. It should be noted that the above listed material are used as an example, and should not be seen as to limit the scope of the present invention.

The track 12 is generally comprised of a tubular member. The width of the tubular track 12 is sufficient so that a caddy 16 may travel inside the tubular track 12. The tubular track 12 will have a channeling 18 located on a bottom section of the track 12. The channeling 18 runs the entire length of the tubular track 12 and is continues and unobstructed when the track 12 is fully constructed. The channeling 18 is used so that a toy model 15 may be coupled to the caddy 16 and transported around the track 12.

Located within the tubular track 12 is a pair of conductive strips 20. A first strip 20A is located on a first side of the channeling 18. A second strip 20B is located on the second side of the channeling 18. The pair of conductive strips 20 run the entire length of the track 12. When the track 12 is laid on the ceiling in a completed form, each of the conductive strips 20 will form a complete loop so as to form a complete electrical circuit.

Figure 2:
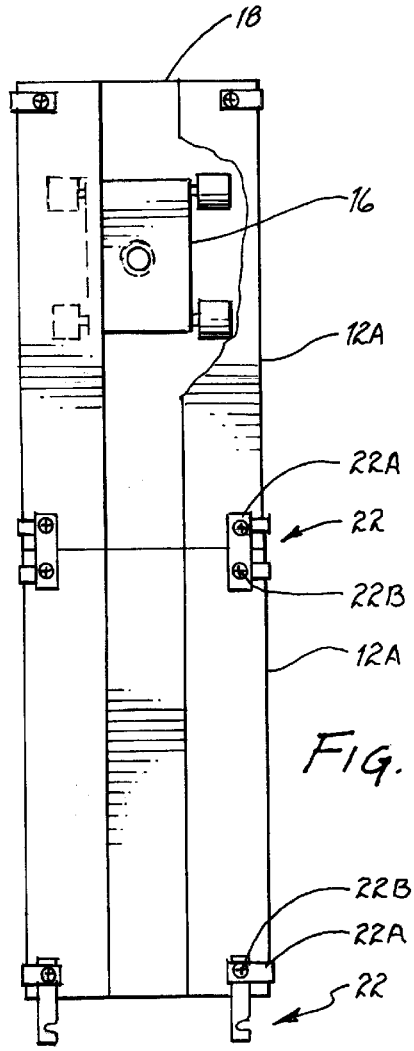
FIG. 2 is a bottom view of one section of the ceiling mounted railing system for model toys of the present invention.
Figure 3:
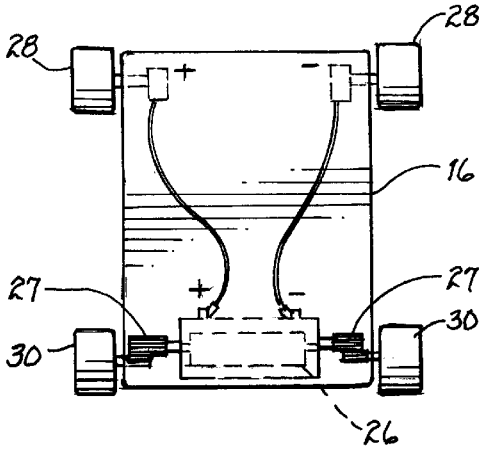
FIG. 3 is a bottom view of the caddy device used to move the toy models in the ceiling mounted railing system of the present invention.
Figure 4:
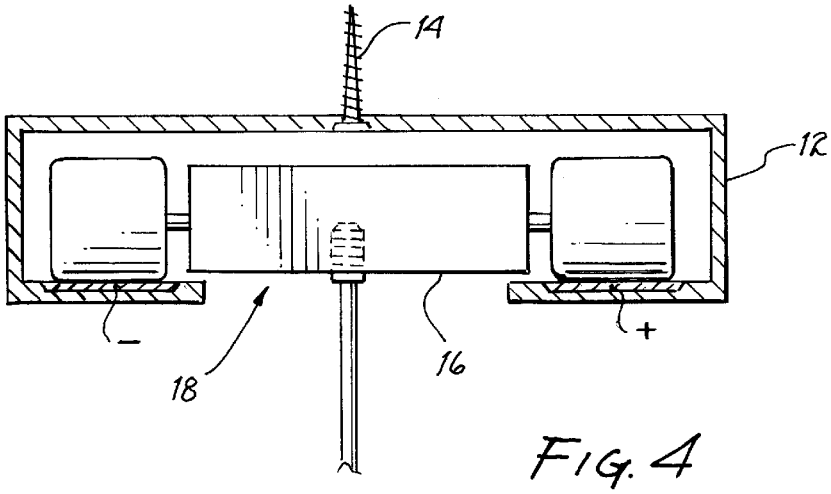
FIG. 4 is a cross-section front view of the ceiling mounted railing system showing a caddy device within the railing system.
Figure 5:
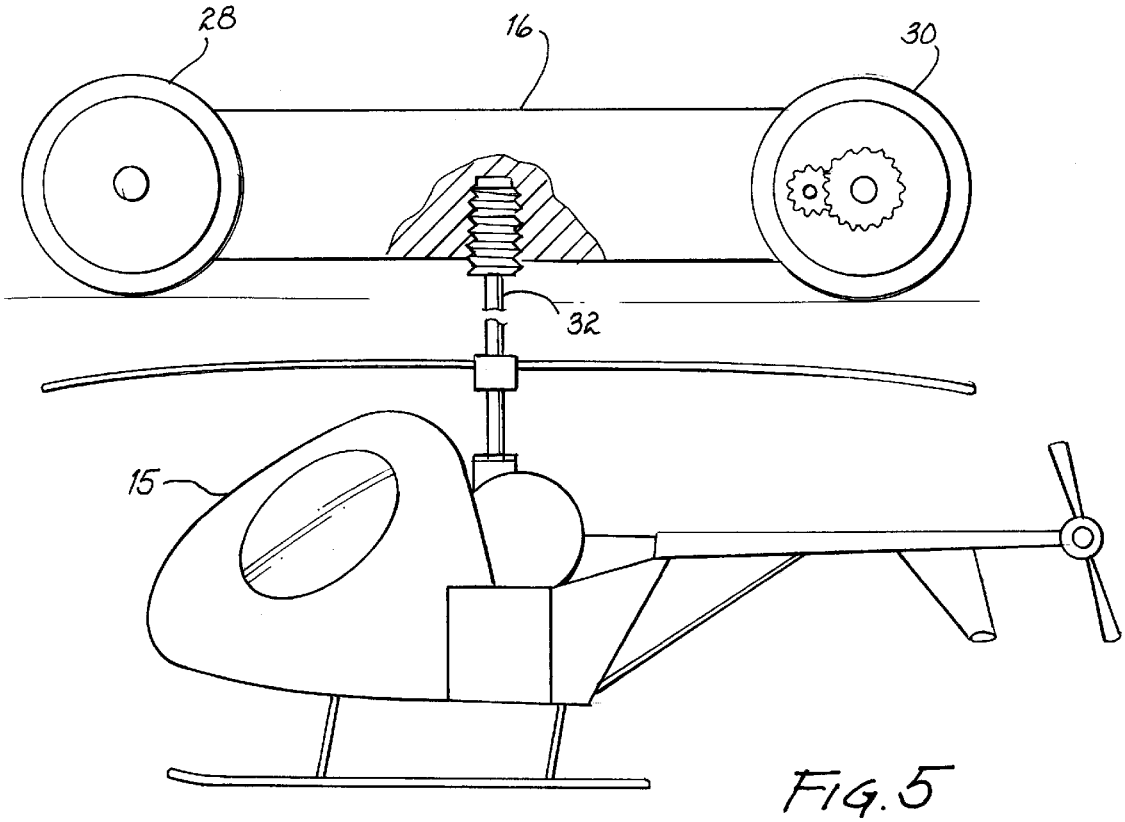
FIG. 5 is a side view of the caddy device holding and transporting a toy model.

The track 12 may be comprised of a single preformed piece which is mounted on the ceiling. Alternatively, the track 12 may be comprised of one or more different sections 12A. A section 12A is mounted on the ceiling of the room where the system 10 is to be installed. Another section 12A is then coupled to the first section 12A and to the ceiling of the room. As shown in FIG. 2, each section 12A is coupled to one another to form a smooth continuous track 12 and to ensure electrical conductivity of the pair of conductive strips 20. A plurality of fasteners 22 are used to connect successive pieces of the track 12 together. The fasteners 22 are used to connect successive track sections 12A together. The fasteners 22 may further be used to ensure conductivity between successive track sections 12A. In accordance with one embodiment of the present invention, the fasteners 22 are made of a conductive material to aid in the conductivity of the pair of conductive strips 20. In the embodiment depicted in FIG. 2, the fasteners 22 are comprised of a clip plate 22A and connectors 22B. A first end of the clip late 22A is coupled to one end of a track section 12A. A second end of the clip plate 22A is coupled to one end of a successive track section 12A. The clip plate 22A is coupled to the track section by a connector 22B. The connector 22B may be a screw, rivet, pin or the like. As stated above, the listing of different types of connectors 22B should not be seen as to limit the scope of the present invention. Other types of fasteners 22 may be used. For example, a male/female fastener 22 or other types of interlocking fasteners 22 may be used.

The track 12 is coupled to a power source 24. The power source 24 has a first terminal 24A which is coupled to the first conductive strip 20A and a second terminal 24B which is coupled to the second conductive strip 20B. The power source 24 is used to provide power to the caddy 16 and to drive the caddy 16 around the track 12. In accordance with one embodiment of the present invention, the power source 24 is a low voltage power source 24. The low voltage power source 24 is a 110 volt AC to 12 volt power supply 24 with a variable speed control 25.

The caddy 16 has a motor 26. The motor 26 is used to drive the caddy 16 around the track 12. The motor 26 is coupled to the pair of conductive strips 20 which will power the motor 26. The motor 26 is coupled to the conductive strips 20 through a first pair of wheels 28. The wheels 28 are conductive contact wheels 28. The wheels 28 are rotatably coupled to the caddy 16 thus allowing the wheels 28 to freely rotate when the caddy 16 is moving along the track 12. The motor 26 is further coupled to a second pair of wheels 30. The second set of wheels 30 are coupled to the motor 26 through a pair of drive gears 27.

In operation, the power source 24 will energize the conductive strips 20. The conductive contact wheels 28, which are in contact with the conductive strips 20 when the caddy 16 is positioned within the track 12, will energize the motor 26. The motor 26, when energized, will cause the drive gear 27 to rotate, thus rotating the second set of wheels 30 and driving the caddy 16 around the track 12. For added traction, the second set of wheels 30 may be made from a rubberized compound.

The caddy 16 will have a post member 32 extending down from the body section of the caddy 16. The post member 32 will extend down from the body section and through the channeling 18 of the track 12. On another end of the post member 32 is coupled a toy model 15 like an airplane, helicopter, ship, car, etc. The post member 32 is used to carry the toy models 15 around the track 12. The, when the caddy 16 runs around the track 12, the toy models 15 will look like they are flying in the air.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A toy model transportation system comprising, in combination:

a track mounted on a ceiling of a room wherein the track is comprised of a tubular member having a channel which runs along a length of the track;

a pair of contact strips coupled within the tubular member;

a power supply coupled to the pair of contact strips; and a caddy positioned within the tubular member and is coupled to the contact strips.

2. The toy model transportation system in accordance with claim 1 further comprising:

a rod member extending down from the caddy and through the channeling; and a toy model coupled to the rod member.

3. The toy model transportation system in accordance with claim 1 wherein the track comprises a plurality of track sections wherein the plurality of track sections are coupled together to form the track.

4. The toy model transportation system in accordance with claim 1 wherein the power supply is a low voltage power supply.

5. The toy model transportation system in accordance with claim 4 wherein the power supply is a variable speed control power supply.

6. The toy model transportation system in accordance with claim 1 wherein the caddy comprises:

a body section;

a motor coupled to the body section;

a pair of contact wheels coupled to the contact strips and to the motor; and a pair of drive wheels coupled to a drive gear of the motor.

7. A toy model transportation system comprising, in combination:

a track mounted on a ceiling of a room wherein the track is comprised of a tubular member having a first end, which is coupled to a second end of the tubular member to form a complete electrical circuit;

a channel which runs along an entire length of the track;

a pair of contact strips coupled within the tubular member and on both sides of the channel;

a power supply coupled to the pair of contact strips;

a caddy positioned within the tubular member and is coupled to the contact strips;

a rod member extending down from the caddy and through the channeling; and a toy model coupled to the rod member.

8. The toy model transportation system in accordance with claim 7 wherein the track comprises a plurality of track sections wherein the plurality of track sections are coupled together to form the track.

9. The toy model transportation system in accordance with claim 7 wherein the power supply is a low voltage power supply.

10. The toy model transportation system in accordance with claim 9 wherein the power supply is a variable speed control power supply.

11. The toy model transportation system in accordance with claim 7 wherein the caddy comprises:

a body section;

a motor coupled to the body section;

a pair of contact wheels coupled to the contact strips and to the motor; and a pair of drive wheels coupled to a drive gear of the motor.

12. A method of providing a toy model transportation system comprising the steps of:

mounting a track on a ceiling of a room wherein the track is comprised of a tubular member having a channel which runs along a length of the track;

attaching a pair of contact strips within the tubular member;

coupling a power supply to the pair of contact strips; and positioning a caddy within the tubular member and coupled to the contact strips.

13. The method of claim 12 further comprising the steps of:

coupling a rod member to the caddy wherein the rod member extends down from the caddy and through the channeling; and coupling a toy model to the rod member.

14. The method of claim 12 wherein the track comprises a plurality of track sections wherein the plurality of track sections are coupled together to form the track.

15. The method of claim 12 wherein the power supply is a low voltage power supply.

16. The method of claim 15 wherein the power supply is a variable speed control power supply.

17. The method of claim 1 wherein the caddy comprises:

a body section;

a motor coupled to the body section;

a pair of contact wheels coupled to the contact strips and to the motor; and a pair of drive wheels coupled to a drive gear of the motor.

* * * * *